United States Patent [19]

Brucker et al.

[11] Patent Number: 4,487,583

[45] Date of Patent: Dec. 11, 1984

[54] RECEIVER GARMENT FOR WEAPONS ENGAGEMENT SIMULATION SYSTEM

[75] Inventors: Stephen E. Brucker, Albuquerque; Larry K. Blankenship, Sandia Park, both of N. Mex.

[73] Assignee: Jaycor, San Diego, Calif.

[21] Appl. No.: 273,774

[22] Filed: Jun. 15, 1981

[51] Int. Cl.[3] ..... F41J 5/02

[52] U.S. Cl. ..... 434/22; 273/371

[58] Field of Search ..... 273/311; 434/21, 22, 434/23

[56] References Cited

U.S. PATENT DOCUMENTS

| | | | |
|---|---|---|---|
| 3,549,147 | 12/1970 | Katter | 273/312 |
| 3,633,285 | 1/1972 | Sensney | 35/25 |
| 3,792,535 | 2/1974 | Marshall et al. | 35/25 |
| 3,811,204 | 5/1974 | Marshall et al. | 434/22 |
| 3,847,396 | 11/1974 | Ashford | 434/22 |
| 3,898,747 | 8/1975 | Marshall | 35/25 |
| 3,938,262 | 2/1976 | Dye et al. | 35/25 |
| 3,995,376 | 12/1976 | Kimble et al. | 35/25 |
| 4,048,489 | 9/1977 | Giannetti | 35/25 |
| 4,063,368 | 12/1977 | McFarland et al. | 35/25 |
| 4,083,560 | 4/1978 | Kikuchi et al. | 35/25 |
| 4,102,059 | 7/1978 | Kimble et al. | 35/25 |
| 4,177,580 | 12/1979 | Marshall et al. | 35/25 |
| 4,195,422 | 4/1980 | Budmiger | 35/25 |

FOREIGN PATENT DOCUMENTS

| | | | |
|---|---|---|---|
| 2426479 | 1/1980 | France | 273/311 |

OTHER PUBLICATIONS

"*Zap! You're Dead*"; Sep. 1979; *Popular Mechanics Magazine*, p. 83.

Lawrence Curran and Stephen E. Scrupski, "Lasers to Keep GIs on Target," Electronics, Jun. 23, 1977, pp. 96–97.

*Primary Examiner*—Vance Y. Hum

*Assistant Examiner*—Leo P. Picard

*Attorney, Agent, or Firm*—Fitch, Even, Tabin & Flannery

[57] ABSTRACT

A weapons engagement simulation system includes a weapon simulator having a laser transmitter for transmitting pulses of directed coherent light in a characteristic temporal pattern and a receiver garment. A plurality of photosensitive detectors distributed over each of a plurality of discrete zones on the outside of the garment respond to light from the laser transmitter by producing electrical detection pulses systematically related thereto. Comparators compare the electrical detection pulses from the photosensitive detectors in a respective zone with a predetermined threshold level and produce discriminated detection pulses when said electrical detection pulses are greater than the threshold level. A decoder compares the temporal patterns of the discriminated detection pulses with a temporal pattern characteristic of the laser transmitter and produces a hit signal corresponding to a respective corresponding zone when the compared patterns correspond. Visual indicators disposed in respective zones provide visual signals when actuated by the respective hit signals. Priority is given to hits in accordance with predetermined priority given respective zones.

9 Claims, 8 Drawing Figures

Fig. 1.
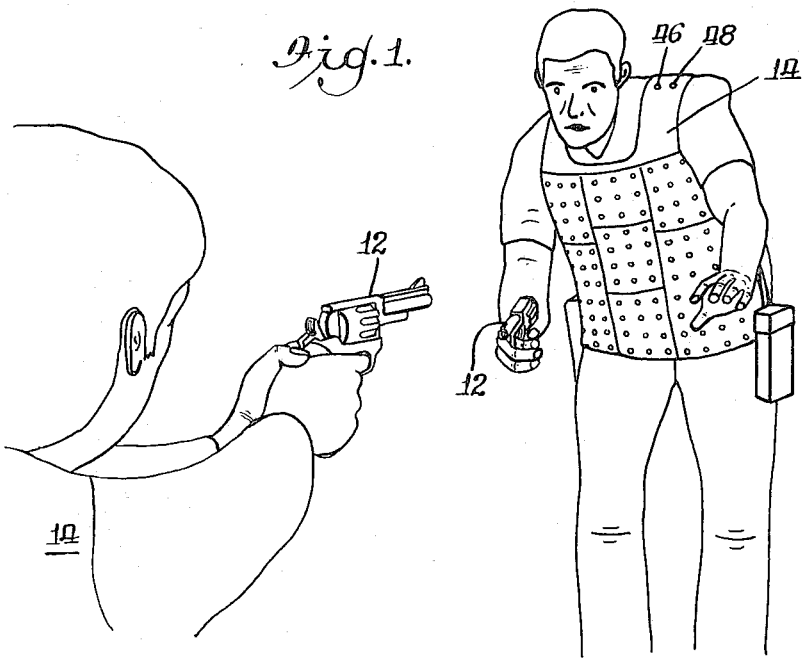
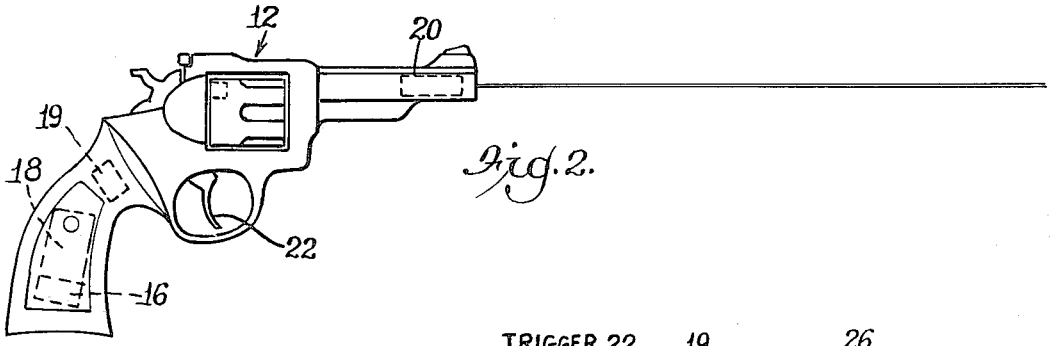
Fig. 2.
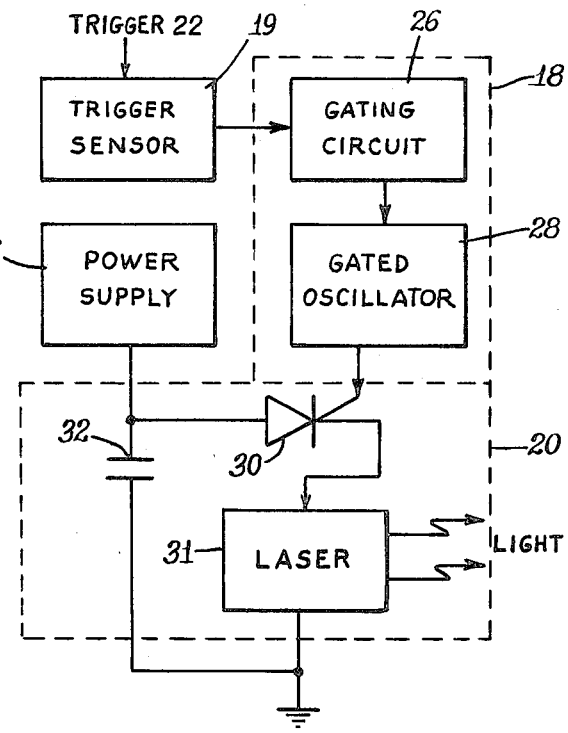
Fig. 3.

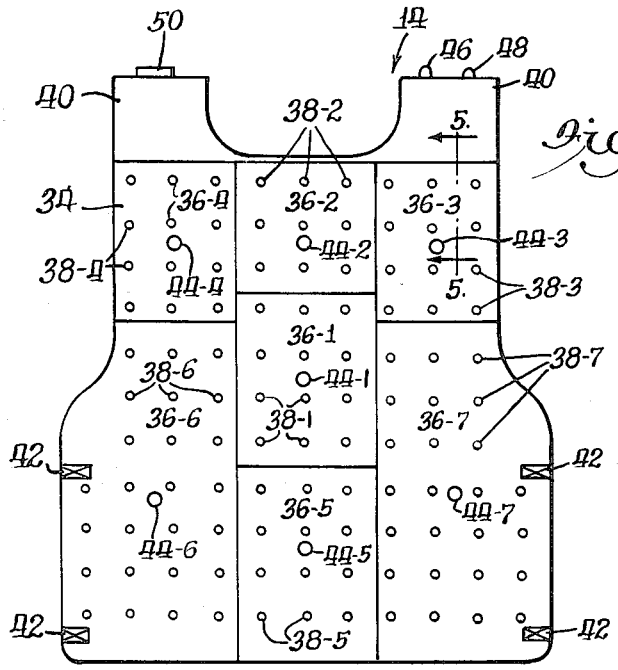
Fig. 4.
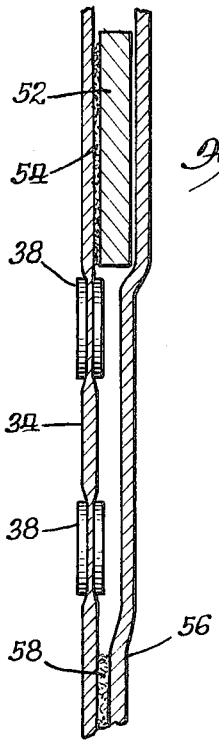
Fig. 5.
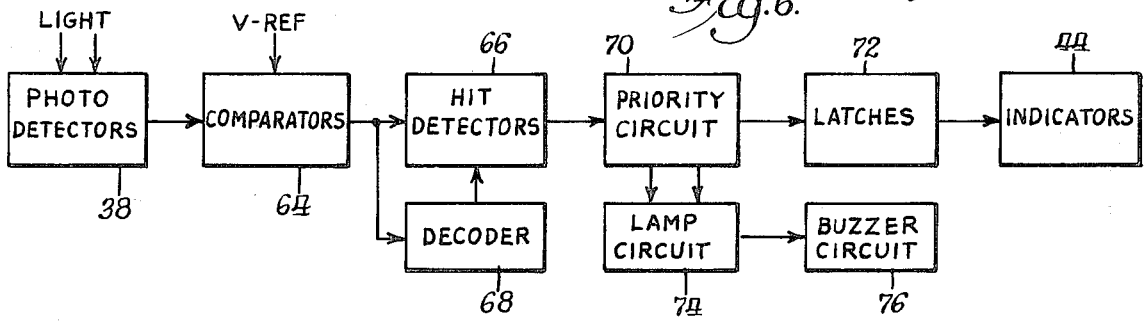
Fig. 6.
Fig. 8.
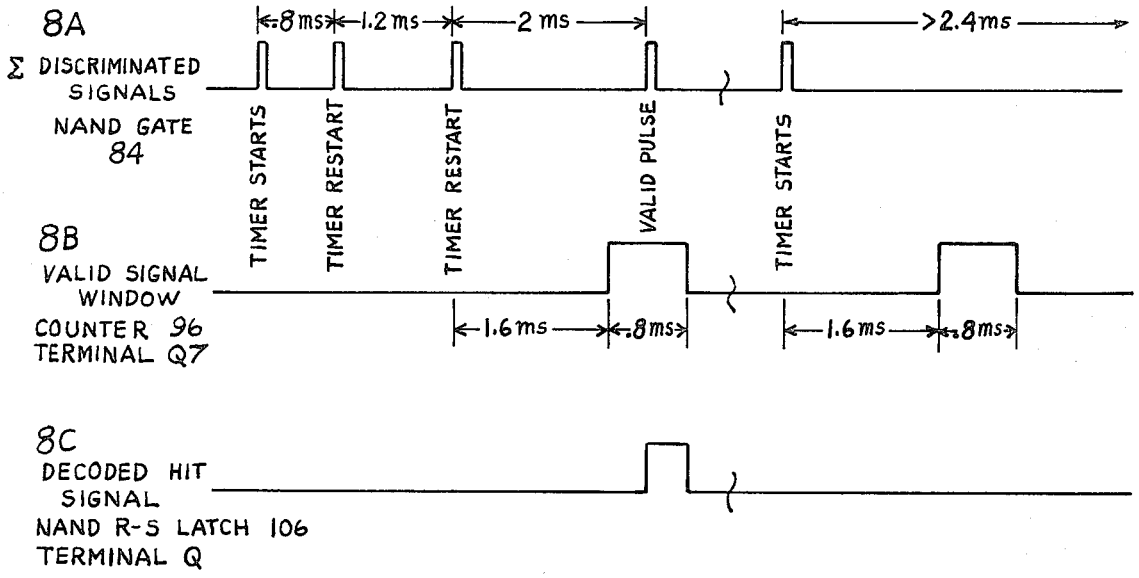

RECEIVER GARMENT FOR WEAPONS ENGAGEMENT SIMULATION SYSTEM

The present invention relates to a weapons engagement simulation system utilizing laser beams and more particularly to a receiver garment for use in such system.

Interest has developed in the use of lasers as training tools in military training, as to improve combat tactics or marksmanship. Several such systems are disclosed in "Lasers to keep GIs on target," by Lawrence Curran and Stephen E. Scrupski, Electronics, June 23, 1977, pages 96 and 97. In such systems a laser transmitter is attached to a weapon, and photodetectors are disposed on remote men or vehicles. As the soldiers fire their lasers at various men, vehicles or other targets, the photodetectors sense whether or not hits have been made. In one system, Miles, detectors are disposed on harnesses worn by infantrymen. Receiver electronics decode the received laser signal to sound an alarm in the Miles system. Each laser transmitter is operated in a pulse-code-modulated fashion to transmit a laser beam in the near infrared in accordance with a code. The Miles system and the other systems disclosed in the above-noted article are designed to substitute laser simulated bullets for live ammunition, while providing the elements of realistic exchange of gunfire.

The present invention is directed to a weapons engagement simulation system particularly applicable to close range simulation, most particularly with handguns. This system includes a weapon simulator which may simulate a standard service handgun and includes a laser transmitter for transmitting pulses of directed coherent light in a characteristic temporal pattern.

A receiver garment, preferably in the form of a vest, covers at least a substantial portion of the front upper body of an individual, and preferably both the front and the back of the upper body. A plurality of photosensitive detectors are distributed over the garment, preferably evenly, with a plurality of detectors in each of a plurality of discrete zones. The outputs of the photosensitive detectors of each zone are applied to a discriminator which compares the magnitude of the detection pulses from a particular zone with a predetermined threshhold, thus identifying received pulses above a noise level. For further discrimination against noise, the discriminated pulses are applied to a decoder which compares the temporal pattern of the discriminated detection pulses with a temporal pattern characteristic of the laser transmitter. This then identifies signals as validly received from the laser transmitter, hence identifying a hit on the garment. Hits are then indicated by visual indicating means disposed in the respective zones for providing a visual signal when actuated. In one embodiment of the invention, a priority means determines whether or not the hits are in a certain zone or in certain zones, as would suggest a lethal, or at least incapacitating, hit. When there are multiple hits, preference is given to the more lethal hit. Further, means are provided for indicating when the hits are made in zones of the higher priority, as by lighting a lamp of characteristic color or sounding a buzzer in characteristic fashion.

Thus a principal aspect of the present invention is to provide a self-contained receiver garment for detecting hits from a weapon simulator emitting pulses of directed coherent light in a characteristic temporal pattern. Other aspects and advantages of the invention will be come apparent from the following detailed description, particularly when taken in connection with the appended drawings, in which:

FIG. 1 is a general pictorial illustration of the use of such garment in a weapons engagement simulation system, showing the exterior of a receiver garment in accordance with the present invention;

FIG. 2 is a side elevation of a handgun simulator used in the weapons engagement simulation system shown in FIG. 1, with the location of the parts of the laser simulation system shown by dashed lines;

FIG. 3 is a diagrammatic illustration of the electronic and laser transmitter parts of the handgun simulator shown in FIG. 2;

FIG. 4 is a front elevation of the receiver garment of the present invention shown in FIG. 1;

FIG. 5 is an enlarged cross-sectional view of a portion of the receiver garment shown in FIG. 4, taken along line 5—5 of FIG. 4;

FIG. 6 is a block diagram of the electronic parts of the receiver garment shown in FIG. 4;

FIG. 8 is an illustration of the waveforms of the electronic signals developed at respective points in the circuit shown in FIG. 7.

Figure 7:
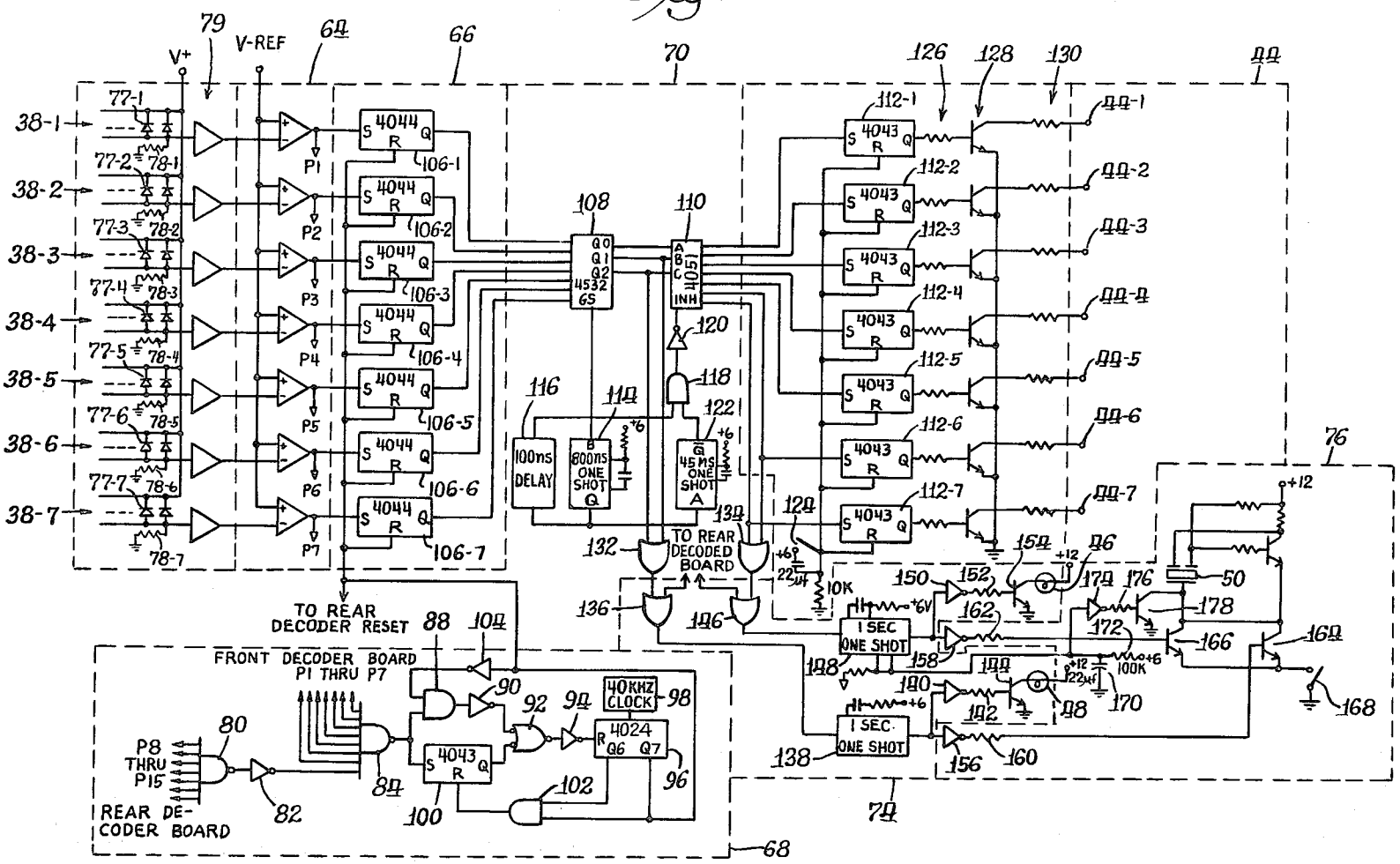
FIG. 7 is a circuit diagram showing the details of the electronic parts of the receiver garment shown generally in FIG. 6.

FIG. 1 illustrates a typical use of the present invention. FIG. 1 shows two men engaged in a simulated gunfight. Each man operates a laser simulation weapon 12 and wears a receiver garment 14. As shown, the weapons 12 are in the form of handguns, specifically, modified revolvers that weigh the same and handle in the same fashion as a standard law enforcement short range handgun. The receiver garments 14 are preferably in the form of vests fitting loosely over the upper bodies of the respective participants without hindering the participants' movements in any respect.

As shown more particularly in FIG. 2 and FIG. 3, each weapon 12 includes the parts necessary to permit operation of the weapon to emit a laser beam of characteristic qualities. The gun illustrated is a standard law enforcement revolver that has been modified to render it incapable of shooting live ammunition. The barrel has been plugged and the chamber modified to accept special blank cartridges for simulating the sound of live ammunition. The electronic circuitry for the weapon 12 is illustrated in FIG. 3, with the physical disposition of the elements being illustrated in FIG. 2.

As illustrated in FIG. 2, the major physical pieces of the laser system are a power supply 16, electronic circuitry 18, a trigger sensor 19, and a laser transmitter 20. The weapon 12 includes a trigger 22 for actuating the laser system.

As illustrated in FIG. 3, the trigger sensor 19 operates in response to the pulling of the trigger 22 to provide a trigger signal to a gating circuit 26 in the electronic circuitory 18. The gating circuit 26 supplies an enabling signal to a gated oscillator 28 in the electronic circuitry 18. The gated oscillator 28 then provides signals to a silicon controlled rectifier (SCR) 30 in the laser transmitter 20. A capacitor 32 in the laser transmitter 20 is charged from the power supply 16 and discharged upon triggering of the SCR 30 to apply power to a laser 31 within the laser transmitter 20 in pulses in synchronism with the signals from the gated oscillator 28. The frequency of the gated oscillator 8 may be 500 Hz, thus producing a pulse every 2 milliseconds. The gating circuit 26 may enable the gated oscillator 28 for a predetermined number of cycles, or for a particular period. For example, the gating circuit 26 may be a one shot multivibrator enabling the gated oscillator 28 to produce eight pulses 2 milliseconds apart. The laser transmitter 20 will thereupon produce a burst of coherent light in a series of eight pulses 2 milliseconds apart each time the trigger 22 is pulled. The light may be infrared. Each participant, therefore, aims and fires his weapon 12 in a conventional manner, attempting to shoot his opponent in the upper body, trying either to "wound" him or to "kill" him, as the case may be. Meanwhile, of course, his opponent may be firing back.

The receiver garment 14 worn by each participant provides a means for scoring or indicating how well his fellow participant is performing. The exterior of the receiver garment 14 is illustrated in FIG. 4, and a partial cross section is illustrated in FIG. 5. A block diagram of the electronic circuitry of the weapons garment 14 is illustrated in FIG. 6, with a more detailed circuit diagram being shown in FIG. 7.

In general the receiver garment 14 is formed of a fabric cover 34, which covers the upper body of each participant, both front and back. The cover 34 is divided on each of the front and the back into seven zones 36-1 to 36-7 and 36-8 to 36-14, respectively. Photosensitive detectors 38 are distributed relatively uniformly over the entire outside of the front and back of the cover 34 so as to provide relatively uniform detection of laser beams striking the upper body of the participant, wherever the beams might strike. A plurality of photosensitive detectors 38 are disposed in each zone 36. There are sufficient detectors placed sufficiently close together that a laser beam will strike one or other of the detectors 38, no matter where the beam strikes the garment 14.

As shown in FIGS. 1, 4 and 5, the photosensitive detectors 38 may comprise photodiodes at the surface of the receiver garment 14. As one alternative, the photosensitive detectors may comprise a fiber optics network which pipe the received laser emissions to respective photodiodes located within the body of the receiver garment 14. In such alternative, the distal ends of the fiber optics light conductors may be considered the light receptors of respective photosensitive detectors 38, and distribution of the photosensitive detectors 38 may be effected by appropriate distribution of the distal ends of such fiber optics light conductors. Thus, reference herein to photosensitive detectors distributed over each of a plurability of descrete zones on the outside of the garment includes the alternative wherein fiber optics couples receptors distributed over respective zones to respective photodiodes within the garment.

The front and back of the garment 14 are essentially the same, with the two halves joined by shoulder pieces 40 and held together by straps 42.

Centrally of the respective zones 36 are visual indicators 44 which may be in the form of light emitting diodes (LED's) 44-1 to 44-7, there being corresponding indicators on the back. When the light striking a photodetector 38 in a particular zone 36 is appropriately decoded as coming from the laser transmitter 20 of a weapon 10, the visual indicator 44 in the respective zone 36 lights up, indicating a hit. Additionally a lamp 48 or a lamp 46 mounted on a shoulder piece 40 lights up, indicating whether the hit represents a lethal or incapacitating hit, or represents merely a lesser wound hit. Also in the receiver garment 14, as illustrated in FIG. 4, a buzzer 50 is affixed to a shoulder piece 40 for providing an audible indication of a hit. The weapons garment 14 is self-contained in that it contains all of the electronics and power supplies as required to detect the incoming laser light signals, decode them, and provide appropriate output for driving the respective visual indicators 44, lamps 46 and 48 and buzzer 50. The electronics may be encapsulated in a module 52 attached internally of the receiver garment 14 by suitable attaching means. The garment 14 may include an inner lining 56 fastened to the cover 34 by sewing or other means, such as straps 58.

Referring now to FIGS. 6 and 7, the photosensitive detectors 38-1 to 38-7 in respective zones 36-1 to 36-7 respond to light striking them to produce signals which are amplified and applied to comparators 64 in the form of electrical detection pulses systematically related to the incident light. There the respective pulses are compared with a reference level V-REF. Those signals exceeding the reference level produce discriminated detection pulses that are applied to hit detectors 66. The comparators 64 thus act to discriminate against background light. At the same time the discriminated detection signals that have passed the discrimination level of the comparators 64 are applied to a decoder 68 which responds to discriminated detection signals having an appropriate temporal pattern corresponding to that of the signals from the laser transmitter 20. More particularly, in the illustrated embodiment, the decoder 68 identifies such signals occurring at a particular time interval or at a particular frequency and applies an enabling signal to the hit detectors 66 to enable the hit detectors to accept respective discriminated signals from the comparator circuits 64 when such signals are validated by the decoder 68. This further discriminates in favor of signals arising from operation of the laser transmitter 20.

The output signals from the hit detectors 66 are hit signals identifying hits in particular respective zones 36. These hit signals are applied to a priority circuit 70 which selects among the hit signals in accordance with a hierarchy or priority. That is, the respective zones 36 are assigned particular priority in accordance with a predetermined plan. More especially, the zones 36 are arranged generally in order of degree of damage likely to be produced by a bullet striking the person wearing the vest 14 in particular respective zones 36. Highest priority is awarded to the zone 36-1 lying at the wearer's breastbone over his heart. The next highest priority is awarded zone 36-2 just above, near the throat and upper chest. The next lesser priorities go to zones 36-3 and 36-4 flanking the first and second zones. The next is the zone 36-5 in the lower center of the vest 14. Lowest priority goes to the zones 36-6 and 36-7 flanking the zone 36-5. FIG. 4 illustrates the respective zones 36 for the front of the receiver garment 14. Corresponding zones are on the back of the receiver garment 14. The priority circuit 70 thus selects the hit signal corresponding to a hit in the zone 36 of highest priority and applies it to latch circuits 72, setting a latch corresponding to the respective zone.

A latch signal from the latch circuits 72 is applied to a respective indicator 44-1 to 44-7, causing the respective indicator 44 to light up. At the same time signals from the priority circuit 70 are applied to a lamp circuit 74 to cause a respective lamp 46 or 48 to light up, depending upon the priority. More particularly, the hit detection signals corresponding to respective zones 36-1 to 36-5 cause the lamp 48, which may be red, to light up, indicating a kill or incapacitating wound, whereas a hit in the other zones 36-6 and 36-7 causes the lamp 46, which may be yellow, to light up. Whichever lamp is lit, a signal is applied to a buzzer circuit 76 to operate the buzzer 50.

Referring more specifically to FIG. 7, the photodetectors 38-1 to 38-7 may include respective photodiodes 77-1 to 77-7, there being a plurality of photodetectors 38 in each zone 36. The photodiodes 77 for each zone 36 are conected in parallel between a voltage source V+ and a respective resistor 78-1 to 78-7. Light striking a photodiode 77 causes the flow of current through a respective resistor 78, generating an electrical pulse. These electrical pulses are amplified by respective amplifiers 79 of the photosensitive detectors 38 to produce amplified electrical detection pulses systematically related to the light striking the respective photodiodes. These amplified pulses, which may be considered the detection pulses of the respective photosensitive detectors 38, are applied to respective comparators 64.

Each comparator 64 compares the amplified electrical detection pulses arising from light striking a particular respective zone 36 with the voltage reference level V-REF and produces a low output discriminated detection pulse whenever an amplified electrical detection pulse exceeds the voltage reference level. The discriminated detection pulses are developed at respective output terminals P1 to P7 of the comparator 64 and are applied to the input terminals P1 to P7 of the decoder 68. Similar photodetectors 38 and comparator circuits 64 for the zones 36 on the back of the receiver garment 14 produce comparable discriminated detection pulses on terminals P8 through P14. As noted above, the respective terminals P1 to P14 go low whenever an amplified electrical detection pulse exceeds the voltage reference level. Otherwise the respective signal levels remain high.

The signals at the terminals P8 through P14 are applied to a NAND gate 80 which thus produces a high output whenever the discrimination level is exceeded by the light striking the photodiodes of a respective zone 36 on the back of the receiver garment 14. This signal is inverted by an inverter 82 and applied to a NAND gate 84 along with the signals from the output terminals Pl to P7. Thus, whenever a discriminated detection pulse occurs, indicating that an amplified electrical detection pulse exceeds the discrimination level, the output of the NAND gate 84 goes high for the duration of such pulse. The signals at the output of the NAND gate 84 thus comprise the sum of the discrimination detection pulses and appear in the form illustrated by waveform 8A in FIG. 8.

Thus, whenever light of sufficient intensity strikes the photodiodes 77 of any zone 36, the output of the NAND gate 84 goes high. This high signal is applied to one input of a two input AND gate 88, the other input being normally high. The high signal applied to the AND gate 88 causes the output thereof to go high. This signal is inverted by an inverter 90 and applied to one input of an AND gate 92. With the signal at this input low, the output of the AND gate 92 goes low irrespective of the other input to the AND gate 92. This signal from the AND gate 92 is inverted by an inverter 94 and applied to the R terminal of a 7 stage binary counter 96 (type 4024) which counts pulses applied from a clock 98. The clock 98 operates at a frequency of 40 KHz for the purpose of decoding a 500 Hz pulsed laser beam. The output of the NAND gate 84 is also applied to a NOR R-S latch 100 (type 4043). The Q output of the NOR R-S latch 100 is also applied to the AND gate 92.

In what may be considered the quiescent state of the decoder 68, that is, the period between cycles, the input to the AND gate 88 from the NAND gate 84 is low, the other input to the AND gate 88 is high, the inputs to the R and S terminals of the NOR R-S latch 100 are low, and the Q output of the NOR R-S latch 100 is low. The latter holds the output of the AND gate 92 low, operating through the inverter 94 to apply a high signal to the R terminal of the counter 96, thus holding the counter 96 in its reset condition. Upon the occurrence of a high output from the NAND gate 84, the high signal to the S terminal of the NOR R-S latch 100 causes the Q output to go high. The high signal to the AND gate 88 causes its output to go high for the duration of the pulse, but the output thereafter goes low. This low signal is inverted by the inverter 90. As both inputs to the AND gate 92 are then high, its output goes high. This is inverted by the inverter 94 to apply a low signal to the R terminal of the counter 96, enabling the latter to count.

Until the AND gate 88 is disabled, as discussed below, any high pulse applied to the AND gate 88 from the NAND gate 84 will cause the 7 stage binary counter 96 to be reset, with the counting beginning again at the end of the pulse. Unless the counter 96 is meanwhile reset, the output terminal Q6 of the 7 stage binary counter 96 will go high after 0.8 milliseconds and remain high for another 0.8 milliseconds, whereupon it will go low, and the output terminal Q7 will go high at 1.6 milliseconds. The terminal Q6 will again go high after another 0.8 milliseconds, the terminal Q7 remaining high. The outputs from terminals Q6 and Q7 are applied to an AND gate 102, the output of which thus goes high at 2.4 milliseconds after the starting of counting of the clock pulses by the seven stage binary counter 96. The output of the AND gate 102 is applied to the R terminal of the NOR R-S latch 100. Unless a subsequent pulse happens to be at the same time applied from the NAND gate 84, the S terminal of the NOR R-S latch 100 will be low. Even if the S terminal is coincidently high, it will go low at the end of the pulse. Consequently, the appearance of a high signal on the R terminal causes the Q terminal to go low. This operates through the AND gate 92 and the inverter 94 to reset, but not restart, the 7 stage binary counter 96.

Meanwhile, the output from the terminal Q7 of the NOR R-S latch 100 is applied through an inverter 104 to the AND gate 88 to disable the AND gate 88 for the interval between 1.6 milliseconds and 2.4 milliseconds. This prevents a signal from the NAND gate 84 from operating through the AND gate 88 to reset the NOR R-S latch 100 during this interval.

Upon the resetting of the NOR R-S latch 100 by the output from the AND gate 102, the Q6 and Q7 output terminals from the seven stage binary counter 96 go low, thus driving the R terminal of the NOR R-S latch 100 low and operating through the inverter 104 to enable the AND gate 88. This then places the NOR R-S latch 100 in the quiescent condition for restarting the 7 stage binary counter 96 as described above and enabling the AND gate 88 to permit a pulse from the NAND gate 84 to operate through the AND gate 88 to reset the 7 stage binary counter 96, as also described above. The decoder 68 is thus in condition for decoding the next received burst of discriminated detection pulses occasioned by a subsequent firing of the laser transmitter 20.

The signal at the terminal Q7 of the seven stage binary counter 96 operates as an enabling signal for the hit detectors 66, which comprise NAND R-S latches 106-1 to 106-7 (type 4044). That is, the signal at the terminal Q7 provides a window in time during which signals applied to the S terminals of the respective NAND R-S latches 106-1 to 106-7 may operate to provide respective hit signal outputs at their respective Q terminals. This valid signal window is shown by waveform 8B. Except during the window, the respective R terminals of the NAND R-S latches 106 are low. The inputs to the respective S terminals are high except upon the detection of light by the respective photodiodes 38-1 to 38-7 of sufficient intensity that the respective amplified electrical detection pulses exceed the reference level of the comparators 64, producing corresponding discriminated detection pulses. Even then the Q outputs will all remain low, irrespective of the S inputs, so long as the R terminals are low. This means that when the respective S terminals go low, there is no change in the respective Q terminals so long as the R terminals have not been enabled by the signal from the Q7 terminal of the 7 stage binary counter 96. When the R terminals go high upon the occurrence of such enabling window, the respective output terminals remain low while the S terminals are high. It is only upon the occurrence of a low pulse at a respective S terminal that a NAND R-S latch 106 changes state to a high output at the respective Q terminal, which high remains after the S terminal returns to its normal high condition. The signals at the respective terminals Q of the NAND R-S latches 106-1 to 106-7 are thus respective hit signals, that is, decoded signal pulses indicating hits in the respective zones 36, as shown by waveform 8C.

This decoding of the signals may be further understood by reference to the waveforms of FIG. 8. The signals exceeding the discrimination level V-REF of the comparators 64 produce discriminated detection signals that are applied to the NAND gate 84 to produce signals in the form shown in waveform 8A. The first pulse operates through the NOR R-S latch 100 to start the 7 stage binary counter 96. Subsequent pulses reset and restart the 7 stage binary counter 96 by way of the AND gate 88, so long as such as pulses occur prior to the beginning of a window signal (waveform 8B) at the terminal Q7 of the 7 stage binary counter 96, as such window signal operates to disable the AND gate 88 and hence prevent resetting and restarting. Assuming the 7 stage binary counter 96 is not reset and restarted, a valid signal window signal is developed at the terminal Q7 of the 7 stage binary counter 96 in the form shown by waveform 8B. In the event that a subsequent pulse occurs at the output of any comparator 64 during the period of the valid signal window as shown in waveform 8B, a hit signal appears at a respective terminal Q of a NAND R-S latch 106, as shown by waveform 8C. Pulses appearing at the output of the NAND gate 84 prior to a valid signal window operate to reset the timing of the 7 stage binary counter 96, and a pulse appearing after the end of a valid signal window operates to restart the counter 96, but none of these operate a NAND R-S latch 106.

The hit signal outputs of the hit detectors 66 are applied in parallel to an 8 bit priority encoder 108 (type 4532) of the priority circuit 70. The 8 bit priority encoder 108 operates in response to applied high signals to indicate in octal code on outputs Q0, Q1 and Q2 a high signal on the input line that has the highest priority. In this instance the priorities are assigned in numerical order for zones 36-1 to 36-7. These signals from terminals Q0, Ql and Q2 are applied to the input terminals of an 8 channel multiplexer 110 (type 4051) which applies signals to the S terminals of corresponding NOR R-S latches 112-1 to 112-7 (type 4043) of the latch circuits 72 when the 8 channel multiplexer 110 is not inhibited.

Normally the 8 channel multiplexer 110 is inhibited by a signal applied to its terminal INH. To enable the 8 channel multiplexer 110, a signal is applied from the GS terminal of the 8 bit priority encoder 108 upon receipt of an input high signal to any of its input terminals. This signal from the GS terminal is a strobe signal applied to an 800 nanosecond one shot multivibrator 114, which thereupon produces a high output signal at its terminal Q. This signal is applied through a 100 nanosecond delay circuit 116 to a two input AND gate 118, the other input to the AND gate 118 being normally high. The high signal thus applied to the AND gate 118 causes the output of the gate 118 to go high. This high is inverted to a low by an inverter 120 and applied to the INH terminal of the 8 channel multiplexer 110 to enable the multiplexer to transfer the signal identifying the hit zone to a respective NOR R-S latch 112.

The 100 nanosecond delay in enabling the 8 channel multiplexer 110 is to assure that transients have cleared the lines connected to the terminals Q0, Ql and Q2 of the 8 bit priority encoder 108 before the signals are read out and transmitted by the 8 channel multiplexer 110. The output from the 800 nanosecond one shot multivibrator 114 is also applied to a 45 millisecond one shot multivibrator 122. This multivibrator is triggered by the turning off of the 800 nanosecond one shot multivibrator 114. Its normally high output is driven low for 45 milliseconds. This operates to drive the output of the AND gate 118 low and hence inhibits the 8 channel multiplexer 110 after the 800 nanosecond one shot for a period of 45 milloseconds thereafter. The purpose of this is to assure that no hit signals are transmitted to the NOR R-S latches 112 after the first decoded hit pulse of a group. This is because the pulses are transmitted in bursts of eight, and subsequent pulses may be passed by the decoder 68 for subsequent pairs of pulses in the same burst. It is not desired that such be effective to indicate hits; hence, the 45 microsecond one shot multivibrator 122 precludes the transmission of such information for the remainder of the length of time it takes for the burst of pulses.

At the outset of operation of the system, the NOR R-S latches 112-1 to 112-7 are placed in their reset condition by the momentary closing of a switch 124, which applies a high signal to the respective R terminals. The S terminals are normally low, being driven high only when a hit is decoded by the operation of the hit detectors 66, the decoder 68 and the priority circuit 70. The NOR R-S latches 112 thus normally provide a low output at their respective Q terminals. Upon the occurrence of a high hit signal at a respective S terminal, thus indicating a hit in a respective zone 36, the respective NOR R-S latch 112 changes state and provides a high at its Q output terminal. This high operates through a respective resistor 126 to turn on a respective transistor 128 which in turn operates through a respective resistor 130 to turn on a respective visual indicator 44-1 to 44-7. These visual indicators 44-1 to 44-7 may be appropriate LED's connected to a power supply, not shown, so that when a respective transistor 128 is made conductive, the corresponding LED 44 emits light to indicate a hit in the zone 36 of highest priority amongst the zones 36 detecting the pulses from the laser transmitter 20. The respective visual indicators 44 remain lit until the switch 124 is again momentarily closed to reset the NOR R-S latches 112. The switch 124 may be a push-button switch. The visual indicators 44 thus remain lit until appropriate note is made of the respective hits, permitting scoring and evaluation.

There are two additional outputs from the priority circuit 70. One is by way of an OR gate 132 which receives its inputs from terminals Ql and Q2 of the 8 bit priority encoder 108. The output of the OR gate 132 thus goes high whenever there is a hit on any of zones 36-1 to 36-5, which hits are sufficient to exceed the discrimination level of the comparators 64 and are registered on the respective NAND R-S latches 106-1 to 106-5. Similarly, an OR gate 134 receives its inputs from the outputs of the 8 channel multiplexer 110 corresponding to zones 36-6 and 36-7. Hence, its output goes high whenever there is a hit in either of zones 36-6 and 36-7.

The output of the OR gate 132 together with the output of a similar OR gate from circuitry related to the back of the receiver garment 14 is applied to the lamp circuit 74. More specifically, the two outputs from the OR gate 132 and its counterpart are applied to an OR gate 136 which provides a high output when there are hits in any of the higher priority zones 36-1 to 36-5 and the corresponding zones on the back. This high signal energizes a one second one shot multivibrator 138 to provide a low output for one second at its output terminal. This low is inverted by an inverter 140 and applied through a resistor 142 to turn on a transistor 144, thereby turning on the red lamp 48, indicating a hit in a high priority zone 36.

Similarly, the outputs from the OR gate 134 and its counterpart on the back are applied to an OR gate 146 which operates a one second one shot multivibrator 148. The output of the one shot multivibrator 148 is inverted by an inverter 150 and applied through a resistor 152 to operate a transistor 154, thereby turning on the yellow lamp 46, indicating a hit in a low priority zone 36-6 or 36-7 or one of their counterparts on the back.

The outputs of the one second one shot multivibrators 138 and 148 are also applied through respective inverters 156 and 158, thence through respective resistors 160 and 162 to turn on respective transistors 164 and 166. These, in turn, turn on the buzzer 50 for the periods of the respective one second one shot multivibrators 138 and 148. The buzzer 50 may be disabled by opening a buzzer switch 168.

A capacitor 170 is charged through a resistor 172 when power is first turned on. This develops a low signal which changes to a high signal as the capacitor 170 charges and is applied through an inverter 174 and thence through a resistor 176 to operate a transistor 178. The transistor 178 operates the buzzer 50 momentarily upon turn-on of power, thus indicating that the power is turned on and that the buzzer is operating.

It may be noted that the decoder 68, the lamp circuit 74 and the buzzer circuit 76 are common to the circuitry for both the front and the back of the receiver garment 14. The remainder of the elements illustrated in FIG. 7, as shown for the front of the receiver garment 14, are duplicated for the back.

It may be noted that the visual indicators 44-1 to 44-7 remain lit until turned off manually by the operation of the switch 124. On the other hand, the respective lamps 46 and 48 and the buzzer 50 remain operating only for the period of the respective one shot multivibrators 138 and 148.

Summarizing the operation of the invention, participants in a simulated gun fight each have a simulated weapon 12 including a laser transmitter 20 for transmitting pulses of directed coherent light in a characteristic temporal pattern. Each wears a receiver garment 14 having a cover 34 covering at least a substantial portion of his front upper body. The cover has a plurality of discreet zones 36 on the outside thereof. Normally there are two participants, each having a simulated weapon 12 and wearing a receiver garment 14. It is possible to have more than two participants. It is also possible that only one of the participants has a simulated weapon 12, while the other wears a receiver garment 14. Preferably, however, there are at least two participants in order that the simulated gunfight may be more realistic, particularly in matters of stress and defense.

The participants shoot their respective simulated weapons by pulling the triggers 22 of their weapons 12, thereby causing the respective laser transmitters 20 to emit the pulses of directed coherent light in bursts in a characteristic temporal pattern.

Light striking the photodetectors 38 in the respective zones 36 produces electrical detection pulses systematically related to the light striking them. These signals as amplified are compared against a reference voltage by comparators 64, which thus discriminate against the lesser pulses and produce discriminated detection pulses when the amplified electrical detection pulses are greater than the threshold level. The decoder 68 responds to the discriminated detection pulses and compares their temporal pattern with a pattern characteristic of the laser transmitter. More particularly, when the laser transmitter 20 is operating at a frequency of 500 cycles, the decoder 68 senses when successive pulses are spaced by approximately two milliseconds, specifically, in the present example, by a time between 1.6 milliseconds and 2.4 milliseconds.

The decoder 68 produces a valid signal window signal which enables the respective hit detectors 66 to produce a hit signal when a succeeding pulse comes within the window. The priority circuit 70 then determines the zone 36 of highest priority in which a hit has been detected and applies a signal to an appropriate one of the latches 72, which in turn activates a corresponding visual indicator 44. The appropriate indicator 44 is thus a visual indicating means which is disposed in the respective zone 36 for providing a visual signal when actuated that identifies the zone 36 in which a hit has been made. Such actuation is, of course, occasioned by the actuating means comprising the priority circuit 70 and the latches 72.

In addition, there are the two indicating lamps 46 and 48 of the lamp circuit 74. The lamp circuit 74 responds to particular outputs from the priority circuit 70, whereby one of the lamps is lit upon the occurrence of a hit signal corresponding to a zone 36 having at least a predetermined level of priority, for example, in the present invention, the priority of zones 36-1 to 36-5. The other lamp is lit when there is a hit in a zone 36 of lesser priority. When there is a hit in zones of either priority, the buzzer 50 sounds to provide an audible signal upon the occurrence of any hit signal. The buzzer 50 and the lamps 46 and 48 are automatically turned off after a short interval, the period of the respective one shot multivibrators 138, 148. However, the visual indicating means 44 are turned off manually at such later time as desired, thus permitting analysis of the hits.

Although a preferred embodiment of the invention has been illustrated and described, various modifications thereof may be made within the scope of the present invention. More particularly, the simulated weapon may be other than a handgun, and the temporal pattern may be other than a particular frequency. For example, the laser beam may be pulse-code-modulated. The receiver garment may be other than a vest. It may, for example, be in the nature of a bib, or it may be a more complete garment, such as a jacket with sleeves, or indeed coveralls with photodetectors over the entire garment. The photodetectors may be other than photodiodes. Other discrimination means may be used and other decoding circuits. Other visual indicating means may be used. The buzzer may be differently energized so as to produce different sounds, depending upon the priority of the hit. It is possible to arrange the priorities in a different manner.

What is claimed is:

1. A receiver garment for a weapons engagement simulation system wherein a weapon simulator includes a laser transmitter for transmitting pulses of directed coherent light in a characteristic temporal pattern, said receiver garment being formed to be disposed over at least a substantial portion of the front upper body of an individual and comprising a plurality of photosensitive detectors distributed over each of a plurality of discrete zones on the outside of the garment for responding to light from said laser transmitter by producing electrical detection pulses systematically related thereto, a plurality of discriminating means each responsive to said electrical detection pulses from the photosensitive detectors in a respective zone for comparing the magnitude of said electrical detection pulses with a predetermined threshold level and producing discriminated detection pulses when said electrical detection pulses are greater than said threshold level, decoder means responsive to said discriminated detection pulses for comparing the temporal pattern of said discriminated detection pulses with a temporal pattern characteristic of the laser transmitter and producing a hit signal corresponding to a respective corresponding zone when the compared patterns correspond, visual indicating means disposed in each zone for providing a visual signal when actuated, and actuating means responsive to said hit signals for actuating respective visual indicating means, wherein said actuating means includes priority means responsive to hit signals corresponding to respective zones in accordance with predetermined priority preassigned to respective zones for providing an actuating signal corresponding to a hit signal from a zone having the highest priority, and means for applying said actuating signal to the visual indicating means disposed in the respective zone.

2. A receiver garment in accordance with claim 1 further including additional indicating means responsive to said priority means for indicating the occurrence of a hit signal corresponding to a zone having at least a predetermined level of priority.

3. A receiver garment in accordance with claim 2 wherein said additional indicating means comprises at least one electric lamp visible from a substantial distance.

4. A receiver garment in accordance with claim 3 wherein there are at least two such electric lamps, one for indicating the occurrence of a hit signal corresponding to a zone having at least said predetermined level of priority and one for indicating the occurrence of any other hit signal.

5. A receiver garment in accordance with claim 1 wherein said decoder means includes timing means for producing a hit signal when a discriminated detection pulse occurs after a next preceding discriminated detection pulse by a time greater than a first predetermined time and less than a second than a predetermined time, which first and a second predetermined times are established by said timing means.

6. A receiver garment in accordance with claim 1 wherein said decoder means includes timing means responsive to discriminated detection pulses for producing a window signal of predetermined duration of a predetermined interval after a discriminated detection pulse when no subsequent discriminated detection pulse has occurred meanwhile, and means responsive to said window signal and a discriminated detection pulse occurring during the duration of said window signal for producing said hit signal.

7. A receiver garment for a weapons engagement simulation system wherein a weapon simulator includes a laser transmitter for transmitting pulses of directed coherent light in a characteristic temporal pattern, said receiver garment being formed to be disposed over at least a substantial portion of the front upper body of an individual and comprising a plurality of photosensitive detectors distributed over each of a plurality of discrete zones on the outside of the garment for responding to light from said laser transmitter by producing electrical detection pulses systematically related thereto, a plurality of discriminating means each responsive to said electrical detection pulses from the photosensitive detectors in a respective zone for comparing the magnitude of said electrical detection pulses with a predetermined threshold level and producing discriminated detection pulses when said electrical detection pulses are greater than said threshold level, decoder means responsive to said discriminated detection pulses for comparing the temporal pattern of said descriminated detection pulses with a temporal pattern characteristic of the laser transmitter and producing a hit signal corresponding to a respective corresponding zone when the compared patterns correspond, visual indicating means disposed in each zone for providing a visual signal when actuated, actuating means responsive to said hit signals for actuating respective visual indicating means, said actuating means including priority means responsive to hit signals corresponding to respective zones in accordance with predetermined priority preassigned to respective zones for providing an actuating signal corresponding to a hit signal from a zone having the highest priority, and means for applying said actuating signal to the visual indicating means disposed in the respective zone, and additional indicating means responsive to said priority means for indicating the occurrence of a hit signal corresponding to a zone having at least a predetermined level of priority, said additional indicating means comprising at least one electric lamp visible from a substantial distance, and means for turning off said at least one electric lamp automatically after a short interval without inactivating said visual indicating means.

8. A receiver garment for a weapons engagement simulation system wherein a weapon simulator includes a laser transmitter for transmitting pulses of directed coherent light in a characteristic temporal pattern, said receiver garment being formed to disposed over at least a substantial portion of the front upper body of an individual and comprising a plurality of photosensitive detectors distributed over each of a plurality of discrete zones on the outside of the garment for responding to light from said laser transmitter by producing electrical detection pulses sytematically related thereto, a plurality of discriminating means each responsive to said electrical detection pulses from the photosensitive detectors in a respective zone for comparing the magnitude of said electrical detection pulses with a predetermined threshold level and producing discriminated detection pulses when said electrical detection pulses are greater than said threshold level, decoder means responsive to said discriminated detection pulses for comparing the temporal pattern of said discriminated detection pulses with a temporal pattern characteristic of the laser transmitter and producing a hit signal corresponding to a respective corresponding zone when the compared patterns correspond, visual indicating means disposed in each zone for providing a visual signal when actuated, actuating means responsive to said hit signals for actuating respective visual indicating means, and additional indicating means responsive to hit signals for producing an audible signal upon the occurrence of a hit signal, wherein said additional indicating means includes means for turning off said audible signal automatically after a short interval without inactivating said visual indicating means.

9. A receiver garment in accordance with any one of claims 1, 3, 4, 6 or 8 including manually operated means for resetting said visual indicating means, whereby said visual indicating means identify any hit zones until deliberately turned off, hence permitting evaluation.

* * * * *

UNITED STATES PATENT AND TRADEMARK OFFICE

CERTIFICATE OF CORRECTION

PATENT NO. : 4,487,583

DATED : December 11, 1984

INVENTOR(S) : Brucker, et al.

It is certified that error appears in the above-identified patent and that said Letters Patent is hereby corrected as shown below:

Column 1, line 46, "threshhold" should read --threshold--.

Column 2, line 58, "circuitory" should read --circuitry--.

Column 2, line 67, "8" should read --28--.

Column 3, line 50, "plurability" should read --plurality--.

Column 3, line 50, "descrete" should read --discrete--.

Column 8, line 38, "milloseconds" should read --milliseconds--.

Column 10, line 12, "discreet" should read --discrete--.

Column 12, line 14, Claim 5, after "second" delete --than a--.

Column 12, line 15, Claim 5, after "and" delete --a--.

Column 12, line 49, Claim 7, "descriminated" should read --discriminated--.

Column 13, line 11, Claim 8, after "to" insert --be--.

Signed and Sealed this

*Twenty-eighth* Day of *May 1985*

[SEAL]

*Attest:*

DONALD J. QUIGG

*Attesting Officer*

*Acting Commissioner of Patents and Trademarks*

UNITED STATES PATENT AND TRADEMARK OFFICE

CERTIFICATE OF CORRECTION

PATENT NO. : 4,487,583

DATED : December 11, 1984

INVENTOR(S) : Stephen E. Brucker, et al.

It is certified that error appears in the above-identified patent and that said Letters Patent is hereby corrected as shown below:

Column 14, line 21, "1, 3, 4, 6 or 8" should read --1 to 8--.

Signed and Sealed this

Thirteenth Day of October, 1987

*Attest:*

DONALD J. QUIGG

*Attesting Officer*

*Commissioner of Patents and Trademarks*